United States Patent [19]

Allsop et al.

[11] Patent Number: 4,687,094

[45] Date of Patent: Aug. 18, 1987

[54] CONTAINER DISPLAY METHOD AND APPARATUS

[75] Inventors: Ivor J. Allsop; Michael G. Allsop; James D. Allsop; Eivind Clausen, all of Bellingham, Wash.

[73] Assignee: Allsop, Inc., Bellingham, Wash.

[21] Appl. No.: 816,820

[22] Filed: Jan. 7, 1986

[51] Int. Cl.[4] ..... B65D 5/52

[52] U.S. Cl. ..... 206/44 R; 206/45.26; 220/85 H; 211/88; 248/221.1

[58] Field of Search ..... 248/220.3, 221.1, 225.2; 206/44 R, 45.26; 211/72, 73, 88, 105.1, 105.2; 220/85 H; 215/100 R

[56] References Cited

U.S. PATENT DOCUMENTS

| | | | |
|---|---|---|---|
| Re. 23,286 | 12/1944 | Oliver | 248/506 |
| 674,489 | 5/1901 | Wall | 220/66 |
| 1,939,867 | 12/1933 | Thompson | 220/91 |
| 2,430,302 | 11/1947 | Ringler | 229/16 R |
| 2,749,153 | 6/1956 | Baker | 285/298 |
| 2,841,353 | 7/1958 | Burdick | 248/220.3 |
| 2,901,144 | 8/1959 | Haustrup | 220/91 |
| 2,913,210 | 11/1959 | Tichnor | 248/221.1 |
| 2,961,724 | 11/1960 | Alling | 248/221.2 |
| 3,014,597 | 12/1961 | McWherter | 211/175 |
| 3,191,777 | 6/1965 | Willits, Jr. | 248/220.3 |
| 3,193,108 | 7/1965 | Johnson | 229/164 |
| 3,269,550 | 8/1966 | Marcus | 211/87 |
| 3,300,075 | 1/1967 | Dahl | 215/100 R |
| 3,392,949 | 4/1967 | Meyer, Jr. | 248/221.1 |
| 3,409,260 | 4/1967 | Bleed | 248/221.1 |
| 3,477,677 | 11/1969 | Hindley | 248/220.3 |
| 3,502,294 | 3/1970 | Kalbow et al. | 248/311.2 |
| 3,647,078 | 3/1972 | Fortunato | 211/88 |
| 3,656,727 | 4/1972 | Greenlee | 248/201 |
| 3,669,034 | 6/1972 | Marschak | 108/152 |
| 3,737,131 | 6/1973 | Larson | 248/220.4 |
| 3,944,108 | 3/1976 | Ehik | 220/85 H |
| 4,008,872 | 2/1977 | Thompson | 211/88 |
| 4,109,795 | 8/1978 | Konigsford et al. | 248/221.1 |
| 4,111,297 | 9/1978 | Paulin | 206/44.12 |
| 4,113,009 | 9/1978 | Meyer et al. | 165/154 |
| 4,201,291 | 5/1980 | Davidson | 206/44 R. |
| 4,213,559 | 7/1980 | Meyers | 229/16 D |
| 4,319,531 | 3/1982 | Caldwell | 108/152 |
| 4,403,700 | 9/1983 | Manlove | 211/88 |
| 4,587,151 | 5/1986 | Balland | 206/477 |

FOREIGN PATENT DOCUMENTS

| | | | |
|---|---|---|---|
| 1013297 | 7/1977 | Canada | 211/88 |
| 2451086 | 4/1976 | Fed. Rep. of Germany | 211/88 |

*Primary Examiner*—Stephen Marcus
*Assistant Examiner*—Brenda J. Ehrhardt
*Attorney, Agent, or Firm*—Hughes & Cassidy

[57] ABSTRACT

A container having a base containing portion and a movable cover portion is provided to contain a product for shipment or storage. The cover of the container is removed, and the base portion of the container, having two upstanding side walls, is suspended from a pegboard or slot board by providing two mounting adaptors to engage the side walls. Two mounting connectors, such as J-hooks, are used to interconnect the mounting adaptors to the pegboard or slot board, so as to mount the base portion of the container to display the product.

28 Claims, 14 Drawing Figures

FIG. 9
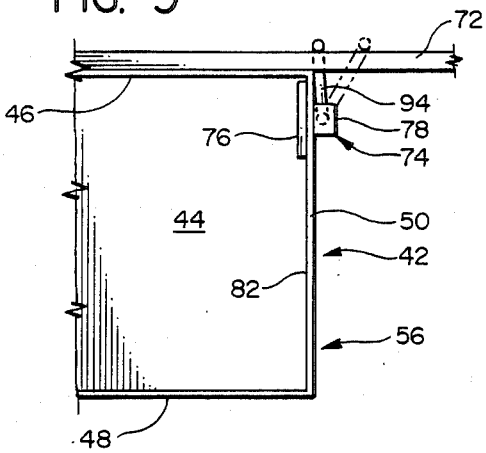
FIG. 11
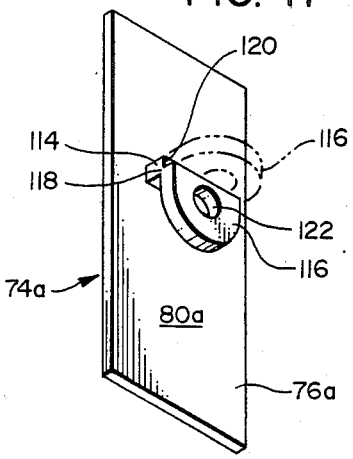
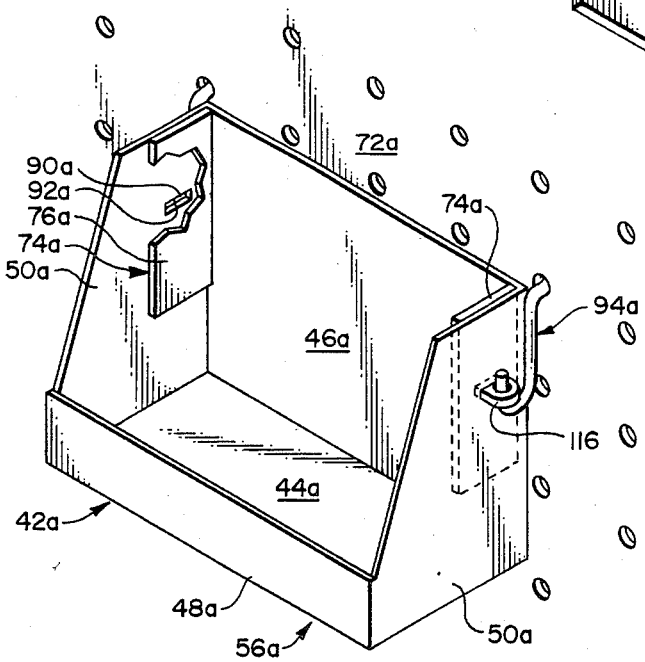
FIG. 10

CONTAINER DISPLAY METHOD AND APPARATUS

BACKGROUND OF THE INVENTION

1. Field of the Invention

The present invention relates to a system by which product, such as a plurality of packaged articles, can be confined within a container which serves its normal purpose of containing the articles, such as for storage and/or shipment, with the container itself then being utilized to mount the product at a convenient location for display and/or easy access.

2. Background Art

There are in the prior art display containers by which product, such as a plurality of packaged articles, can be placed in a container for shipping, storage or the like, with this container being able to be used also for displaying the product. For example, the container can be made up of a base portion which confines the article, generally on at least three sides, and a movable cover portion which can be either torn free of the base portion or folded upwardly therefrom, to expose the product and also make the product accessible to, for example, customers. Normally, such containers are provided for countertop display, or possibly to be placed on shelves.

One of the problems with such containers is that there are many competing used for the countertop area, and quite often such space is limited, the result being that it's not practical to use this premium space for a multiplicity of display packages. Further, shelf space may not readily available, and providing large areas of shelving can also be expensive.

Another form of merchandising is the use of pegboards or slot boards. A pegboard is commonly provided in the form of a large rectangular board (e.g. a sheet of plywood or some composite material) having a plurality of through holes formed therein, these holes being arranged in a uniform rectangular pattern. The wall board is mounted so that it is spaced a short distance (e.g. an inch or less) from a structural wall, and articles are hung to the board by means of J-hooks or some other hanging device. The J-hook has an end hook member to engage a hole or opening provided in the package for the product (or possibly a wire or string attached to the product), and a securing end which is in the form of a right angle finger. The J-hook is placed into the slot board by positioning the shank of the J-hook horizontally, and then slipping the right angle finger into securing engagement with a selected hole in the pegboard. Slot boards function in a quite similar manner, and these differ from a pegboard in that the hook can be moved to any selected location along the horizontal length of the slot.

Among the advantages of such pegboards or slot boards are that they can be provided rather economically, and they provide a good deal of versatility in conveniently displaying the products. The spacing of the holes or slots can be such that small articles can be hung relatively close together, and larger articles can be attached to hooks or slots spaced at a further distance. Further, it's quite convenient for a customer to select an article simply by removing it from the J-hook.

When a plurality of packaged articles are to be mounted to a pegboard or slot board, the usual method is to remove these packaged articles from the shipping carton or container and then hang the articles from the board, as described above. If this container happens to be a display container, such as that described above, quite commonly the container is either discarded or simply used for another purpose.

A search of the patent literature has disclosed a number of patents relating generally to display containers, containers which can be suspended for various purposes, and also various hanging devices for pegboards, slot boards or the like. These are as follows:

U.S. Pat. No. 4,213,599—Meyers discloses what is called a "Divided Display Carton" where the carton is formed by folding a sheet of cardboard of a particular configuration so that it provides a bottom wall, back wall, two side walls, and also a relatively short front wall. The back wall is formed with two through openings by which the carton can be suspended by hooks, pegs or other hanging devices.

U.S. Pat. No. 4,111,297—Paulin shows a carton which contains a plurality of packages, each of which has a hanging tab with a through opening. The cover of the carton can be moved to expose the packages and their hanging tabs. Then a rod-like member can be inserted through the hanging tabs of the several packages so that these packages can then be displayed, presumably by being hung from the rod-like member.

U.S. Pat. No. 3,737,131—Larson shows a support member comprising a horizontal plate member having various opening configurations to hold articles, and a plurality of right angle securing fingers by which the device can be mounted to a pegboard.

U.S. Pat. No. 3,669,034—Marschak shows a device where a shelf can be detachably secured to a pegboard. There are two wire-like hanging devices which can be attached to opposite ends of the shelf member and in turn attached to a pegboard.

U.S. Pat. No. 3,656,727—Greenlee shows a bracket by which a toolbox or tote box can be suspended from a pegboard in its open position. More specifically, this hanging device has arms which support the bottom portion of the box, and also arms which hold the lid in the open position.

A number of patents show containers having openings on their side walls or on laterally positioned tabs so that these openings can be gripped by a handle member or the like to suspend or carry the container. These patents are as follows:

U.S. Pat. No. 674,489—Wall

U.S. Pat. No. 1,939,867—Thompson

U.S. Pat. No. 2,430,302—Ringler

U.S. Pat. No. 2,901,144—Haustrup.

Other fastening and/or mounting devices are shown in the following patents.

U.S. Pat. No. 2,749,153—Baker shows a spring detent coupling device to engage telescoping parts.

U.S. Pat. No. 4,319,513—Caldwell shows a shelf-mounting system by which a shelf can be mounted with J-hooks to a board.

U.S. Pat. No. 4,113,009—Meyer et al discloses a heat exchanger core for a recuperator. The core has a number of laterally projecting tabs by which the core can be mounted.

U.S. Pat. No. 2,241,353—Burdick shows a hook fastener having a J-hook-like member along with another mounting element to assist in mounting the device to a slot board or the like.

U.S. Pat. No. 2,913,210—Tischnor shows a device to display postcards or the like of various sizes to a pegboard. U-shaped brackets are provided to grip the objects to be suspended, and these are in turn mounted by right angle finger members to a slot board.

U.S. Pat. No. 2,961,724—Alling shows a J-hook member for suspending articles to a pegboard, along with a second retaining member engaging the J-hook member.

U.S. Pat. No 3,014,597—McWherter shows what is called a "Hanger Board" where there is a combination of peg slots. A support member has a pair of right angle finger members, one of which fits in a peg, and the other of which fits into a slot.

U.S. Pat. No. 3,269,550—Marcus illustrates a rack mounted to a pegboard. The rack has a plurality of appertures to hold articles.

U.S. Pat. No. 3,392,949—Meyer, Jr. shows a mounting device where J-hook-like members are used to mount a shelf or the like to a pegboard.

U.S. Pat. No. 3,409,260—Bleed shows a connector having a pair of right angle fingers to mount a rod-like device to a pegboard.

U.S. Pat. No. 3,477,677—Hindley shows a J-hook-like member with an adapter or catch 17 engaging the hook.

U.S. Pat. No. 3,502,294—Kalbow et al discloses a device to provide a horizontal mounting surface to support a container from a pegboard.

U.S. Pat. No. Re. 23,286—Oliver shows a securing device to mount an object, such as a plate, to a lower plate. There is a mounting ringer having a triangularly shaped spring-like member which fits through an opening in the base plate.

SUMMARY OF THE INVENTION

The method of the present invention is arranged to contain product for storage and/or shipping, and also mounting the product for display and/or immediate access. The method comprises providing a container having a base portion defining a containing area, and a movable cover portion. This movable cover portion has a first enclosing position where the cover portion interfits with the base portion to enclose the product. The cover portion is then movable to a second position to expose the product in the containing area.

The container is characterized in that the container base portion comprises at least two side walls, each having an inwardly facing surface and an outer surface. Further, the container is constructed so that with said product in the containing area, the base portion with the product therein can be supported from the side walls.

The method further comprises enclosing the product in the container, with the container being in the first enclosing portion. Subsequently, the cover portion is moved from the enclosing position to an open position to expose the product within the base portion of the container.

The method further comprises providing at a connecting location of each side wall a related mounting member having a mounting element in a mounting position. This is done in a manner that each mounting element is positioned outwardly of the outer surface of its related side wall and so that the mounting member is in supporting engagement with the side wall in a manner to leave the containing area substantially unobstructed.

Each mounting element is interconnected to a board support means by a related one of two connecting members. Each of the connecting members has a first connecting end engaging its related mounting element and a second mounting end engaging the board support means. This is done in a manner to support the container base portion with the product therein from the board support means.

The present invention further comprises a packaging assembly for containing the product for storage and/or shipping and also for mounting the product for display and/or convenient access. This packaging assembly comprises the container such as described above, and also a pair of mounting members as described above.

Further, the present invention comprises a mounting assembly comprising a container base such as described above, with the mounting members mounted thereto. There is further provided an apertured board support means and two connecting members connecting the mounting element to the board support means. This is done in a manner that the container base is supported from the board support means.

In a preferred embodiment of the present invention, the mounting members are each provided in the form of a contact plate having a planar contact surface. Each of the side walls is formed with through opening means, and each contact plate is positioned with the contact surface engaging the inwardly facing surface of the side wall. Each mounting member is further provided with support means connected to the contact plate and being positioned in the opening means so as to be in supporting engagement therewith.

In a preferred form, the support means of each of the mounting members comprises at least in part the mounting element being in bearing engagement with its related side wall. In a further preferred embodiment, the support means comprises at least one additional support element extending into the side wall so as to be in bearing engagement therewith.

In a preferred form of the mounting element, it comprises a mounting structure having side wall means and a top wall. The mounting structure defines a downwardly extending opening to receive the connecting end of the related connecting member.

In another embodiment, each mounting element comprises a laterally extending mounting tab means extending through its related opening means. The tab means has a through opening to receive the connecting end of the connecting member. In a preferred form, the tab means is hinge mounted relative to the contact plate. Thus, the tab means can be positioned more closely adjacent the contact plate and also positioned to extend laterally outwardly from the contact plate.

In another embodiment, each mounting member has a first position where the mounting member is aligned with its related side wall so as to form a part of said side wall, and the mounting member can be moved outwardly from the side wall to a mounting position to interengage with its related connecting member. In a further preferred form, the mounting member is made integral with said side wall as a portion thereof. In a further preferred form, there is provided a reinforcing layer connected to the wall means at the location of the mounting member, with at least a portion of the reinforcing layer being connected to the mounting member.

In a further embodiment, the mounting member is bonded to an outside surface of said side wall.

Other features of the present invention will become apparent from the following detailed description.

BRIEF DESCRIPTION OF THE DRAWING

FIG. 9 is a top view showing the same components as in FIG. 7;

FIG. 10 is an isometric view of a second embodiment of the system of the present invention, where there is a modified form of the hanging adapter;

FIG. 11 is an isometric view of the adapter used in this second embodiment;

DESCRIPTION OF THE PREFERRED EMBODIMENTS

Figure 1:
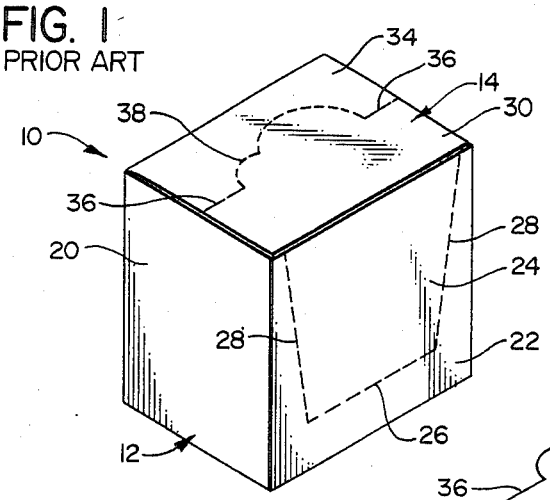
FIG. 1 PRIOR ART
FIG. 1 is an isometric view of a prior art display container in its closed containing position.
Figure 2:
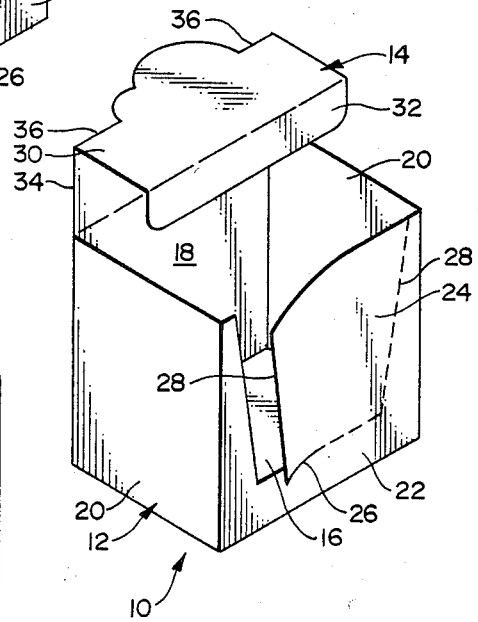
FIG. 2 PRIOR ART
FIG. 2 is a view similar to FIG. 1, but showing the container being open to its display position.
Figure 3:
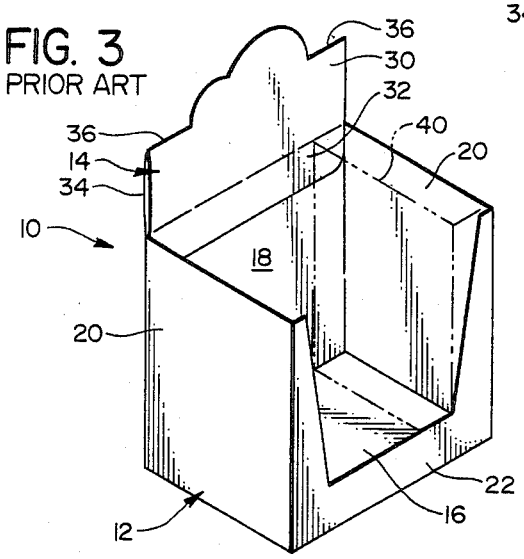
FIG. 3 PRIOR ART
FIG. 3 is a view similar to FIGS. 1 and 2, showing the prior art container in its display position.

It is believed that a clearer understanding of the nature and advantages of the present invention will be achieved by first discussing generally the prior art relating to display containers. In FIGS. 1–3, there is shown one type of display container (generally designated 10) used in the prior art.

This container 10 has a generally rectangular box-like configuration, and comprises a base portion 12 and a removable lid or cover 14. The base portion 12 comprises a bottom wall 16, back wall 18 and two side walls 20. Further, it comprises a front wall 22 having a removable portion 24 of a generally trapezoidal shape. This tear piece 24 has its bottom edge 26 and its two side edges 28 formed along partially perforated tear lines. When the removable portion 24 is removed from the front wall 22 (as shown in FIG. 2), the remaining portion of the front wall 22 has a general U-shaped configuration (as shown in FIG. 3).

The cover 14 is made in two sections, namely a forward section 30 having a downwardly depending closure flap or flange 32, and a rear section 34. The two sections 30 and 34 are hingedly connected to one another about two laterally spaced hold lines 36. Further, the sections 30 and 34 are initially joined along a middle tear line 38 which can have a desired configuration for display purposes or the like.

In the closed configuration of FIG. 1, the container 10 can be used as a storage container or possibly a shipping container. Commonly, the product enclosed in the container 10 would comprise, for example, a plurality of rectangularly shaped packages having a rectangular configuration matching that of the side walls 20, and a width dimension substantially less than the horizontal transverse dimension of the back wall 18. Thus, a plurality of such rectangular packages could be placed side by side in the container 10.

In the closed configuration of FIG. 1, the container 10 performs its customary containing function. When the container 10 with its contained product reaches an end destination, the retailer can use the container 10 as a display device as follows. First, the front removable section 24 can be torn loose, as indicated in FIG. 2, thus exposing the front side of the contained product (one of which is indicated in broken lines at 40 in FIG. 3). Then the cover 14 is moved upwardly and separated along the tear line 38, as the cover 14 is folded along the two side fold lines 36 (as shown in FIG. 2). Then the cover 14 can be moved to a full rearward position, such as shown in FIG. 3, so that the forwardly facing surface of the front section 30 is easily visible as it stands above the contained product 40.

While such prior art display containers 10 certainly serve a useful function, there are, as indicated previously, certain disadvantages. First, the container 10 is commonly supported from an underlying horizontal surface, such as a countertop. Unfortunately, as indicated previously, countertop space which lends itself to attractive display of articles is generally at a premium at a retail establishment. On the other hand, if the display container is placed on a shelf, quite often the benefits of the display container being readily observable to the purchaser are diminished. Further, the vertical spacing of the shelves may be such that it may not accommodate display packages of various heights so that there is quite often wasted space. All too often, the display containers, such as shown at 10, are simply discarded, so that they serve no other function except that of a shipping and storage container.

It is with the foregoing in mind that the system of the present invention was devised. The first preferred embodiment is illustrated in FIGS. 4–9, and in FIG. 4, there is shown a container 42 adapted for use in the present invention. With regard to overall configuration, this container 42 can be totally conventional, and as shown herein, it has a generally rectangular box-like configuration with a bottom wall 44, rear wall 46, front wall 48, two side walls 50, and a top wall 52. The container 42 is formed with tear lines by which a removable cover portion 54 can be removed from the base portion 56 of the container 42. In a particular arrangement shown herein, the tear line extends along the upper rear edge 58, forwardly along a portion of the upper side edges 60, then downwardly in a moderate forward slant at 62 along the side walls 50, and then horizontally at 64 along a lower portion of the front wall 48.

The particular configuration of these tear lines 54–64 is not critical in the present invention, and it is to be understood that other container arrangements could be used, such as the prior art container shown in FIGS. 1–3. As shown herein, the base container portion 56 comprises the full bottom wall 44 and rear wall 46, the greater part of the side walls 50, and a lower forward retaining edge or flange 66 which is the lowermost portion of the front wall 48.

The two side walls 50 are each formed at upper rear portions thereof with a through opening 68 which is shown herein is a generally square or rectangular opening. The lower edge of this opening 68 is formed with a relatively short upstanding retaining tab or finger 70, which is part of the side wall 50. This opening 68 with the tab 70 can be conveniently provided during the initial manufacture of the container 42. More specifically, the container 42 would commonly be made from a sheet of flat cardboard material, the edge portions of which are cut to the appropriate configuration. As part of the operation of forming the edge portions of the container blank 42, the opening 68 with the tab 70 can also be formed. The container is then commonly folded along the appropriate fold lines and bonded to form the finished container.

Figure 4:
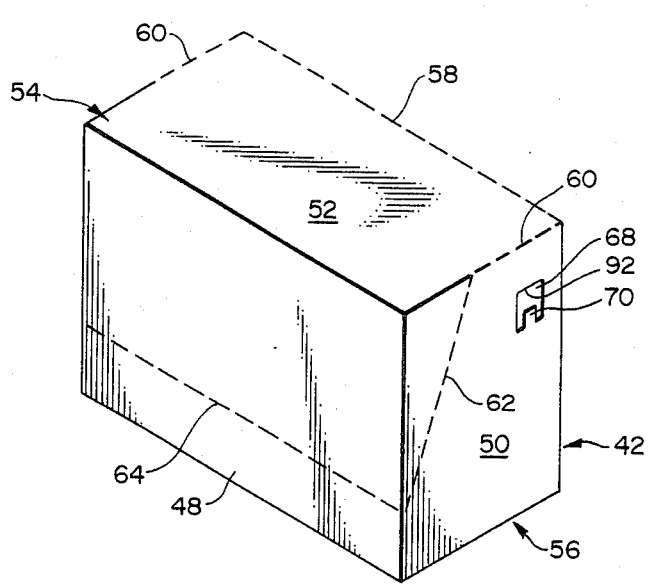
FIG. 4 is an isometric view of a display container adapted for use in the system of the present invention.
Figure 5:
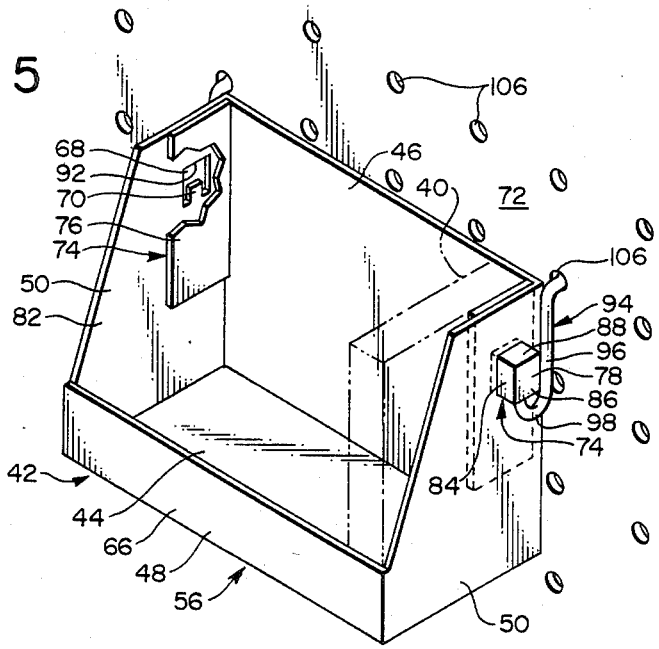
FIG. 5 is an isometric view illustrating the container of FIG. 4 in is open display position, with this container being suspended from a pegboard using the system of the present invention.
Figure 6:
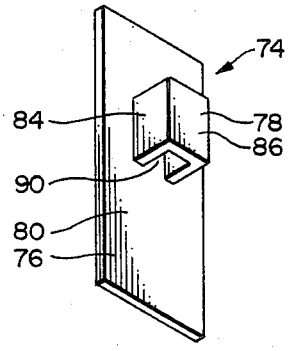
FIG. 6 is an isometric view of a mounting adapter for use in a first preferred embodiment of the present invention.
Figure 7:
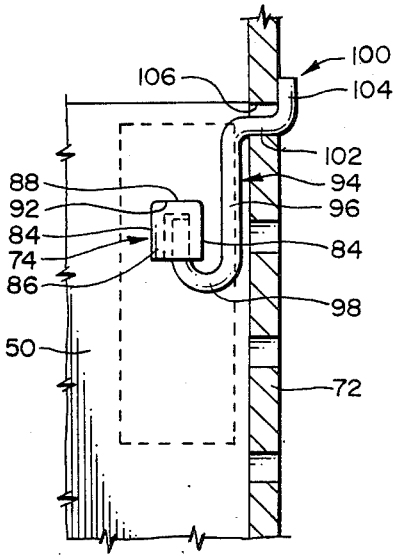
FIG. 7 is a side view, partly in section, showing the adapter of FIG. 6 engaging the container of FIG. 5 and mounted to a pegboard by means of a J-hook.

It is apparent from examining FIGS. 4 and 5 that the container 42 could be used in the same manner as a conventional display container. More specifically, in the closed configuration of FIG. 4, the container 42 can be used for shipping and storage of contained product, such as a plurality of rectangularly shaped containers, one of which is indicated at 40 in FIG. 5. Also, the container 42 could be placed on a counter top or some other horizontal surface to function in the manner of a conventional contaner in a display mode.

However, in addition to the conventional uses, in the system of the present invention, the container 42 can be quite conveniently suspended from a pegboard, such as shown at 72, a slot board or some other hanging device of that type.

To accomplish this, there is provided a mounting adapter 74. This adapter 74 comprises a generally planar mounting plate 76 and a mounting element 78. As shown herein, the plate 76 has a generally rectangular perimeter configuration, and it has a flat contact surface 80 which is adapted to engage an inner surface 82 of a related side wall 50.

The mounting element 78 of each adapter 74 extends outwardly from the contact surface 80 a distance moderately greater than the thickness dimension of its related side wall 50. As shown herein, the mounting element 78 comprises two side walls 84, an outer wall 86 and a top wall 88. The lower side of the mounting element 78 is open, as at 90.

The mounting adapter 74 is placed in its operating position by first locating it adjacent to the inner surface 82 of a related side wall 50 and moving the mounting element 78 through the related side wall opening 68. When this is done, the tab or finger 78 deflects outwardly and downwardly, and then springs back upwardly so as to reach into the opening 90 of the mounting element 78. Thus, this tab serves a retaining function to hold the adapter 74 to the side wall 50. The contact surface 80 of the plate 76 of the adapter 74 fits against the inner surface 82 of the side wall 50. The upper surface of the top wall 88 engages the top edge 92 of the opening 68 in bearing engagement.

With the two adapters 74 in their operating positions mounted to the two side walls 50, the container 42 can be conveniently mounted to the pegboard 72 by means of a pair of J-hooks 94 which are or may be conventional. As shown herein, the J-hook 94 is made by bending cylindrical metal stock of a relatively small diameter (e.g. ⅛th inch) so as to provide a straight shank 96, at one end of which is a 180° bend to form a hook 98. The opposite end of the shank 96 is connected to a right angle finger member 100, comprising a laterally extending section 102 and an upstanding retaining member 104.

To mount the container 42 with its adapter 74 to the pegboard 72, the two J-hooks 94 are inserted into a selected pair of holes or openings 106 in the pegboard 72. The selected holes 106 should be spaced from one another by a distance moderately greater than the horizontal width dimension of the rear wall 46 of the container 42. Each J-hook 94 is inserted into the hole 106 by positioning the shank 96 horizontally, and inserting the retaining member 104 into the selected hole 106. Then the shank 96 is rotated downwardly so as to bring the retaining element 104 upwardly so that it is positioned behind the rear surface of the board 72.

With the J-hooks 94 in place, then the container 42 with the mounting adapters 74 mounted thereto is placed between the J-hooks 94 so that the back wall 46 of the container 42 bears against the forward surface 108 of the pegboard 72. Then the container 42 is lowered slightly so that the hook portions 98 of the J-hooks 94 extend upwardly into the bottom openings 90 of the mounting element 78 of the adapters 74.

The weight of the container 42 with its contained product, such as indicated at 40, may tend to pull the upper portion of the container 42 moderately away from the pegboard 72. However, the J-hooks 94 can easily accommodate themselves to this outward positioning of the upper portion of the container 42. The downward force exerted by the weight of the container 42 and its contained product 40 is resisted by the bearing engagement of the top wall 88 of each mounting element 78 against the related top edge 92 that defines the upper part of the opening 90 in the side wall 50. The horizontal width dimension of the mounting element 78 (i.e. the horizontal dimension parallel to the plane occupied by each side wall 50) is made sufficiently large, relative to the strength of the material which makes up the side walls 50 so that the two side walls 50 are able to support the weight of the container 42 and its product 40.

Figure 8:
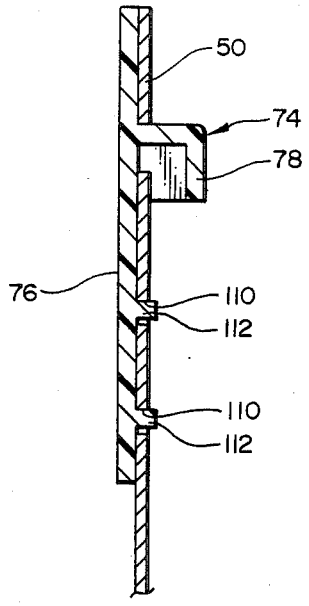
FIG. 8 is a side view, taken partly in section, illustrating a modified arrangement of the mounting adapter of FIG. 6 engaging the side wall of a container.

In the event that additional bearing surface is required, the side walls 50 can, as illustrated in FIG. 8, be formed with one or more openings, such as two slot-like openings shown at 110. Then the plate 76 of the mounting adapter 74 is formed with matching protruding elements 112 which match the openings 110. In the particular configuration shown herein, the openings 110 are made as horizontally extending slots, and the protruding elements 112 are made as horizontally extending flanges or ledges which come into bearing engagement with the upper edges of the openings 110. The effect of this is to increase the total bearing surface by which the container 42 and its product 40 is supported, so that the unit loading at any increment of length along any of the edge portions 92 of the openings 90 or the upper edges of the opening 110 is kept at an acceptably low level.

To describe the overall operation of the present invention, in this preferred embodiment, the container 42 is fabricated in a conventional manner, such as, as indicated above, forming from a cardboard sheet a blank of the appropriate configuration, and then folding this blank into the container configuration and bonding the appropriate portions of the blank to one another to form the finished carton 42. For ease of illustration, the container shown in FIGS. 4–8 is made as a relatively simple box structure. It is to be understood that this container 42 could be made with a top lid or cover, such as shown in FIGS. 1–3. Also, as indicated previously, the two side openings 90 in the side walls 50 (and also the openings 110, if these are used) can be formed as part of the same operation that forms the blank which is made into the container 42.

The two mounting adapters 74 can, if desired, be shipped with the container 42 and its contained product 40. One way of accomplished this is to secure the two adapters 74 (e.g. by adhesive tape) to the container 42, or possibly to place the two adapters 74 inside the container 42. This could be done if the walls of the container 42 are made somewhat flexible so that the moderate protrusion caused by the two adapters 74 would not be excessive.

In the event that the container 42 is to be used for an attractive merchandising display, the container 42 with its product 40 may be placed within a larger more rugged cardboard container for shipment. In this event, the size of the outer container could be made slightly larger to accommodate the inclusion of the mounting adapters 74. An alternative method would be to supply the adapters 74 separately. However, the preferred procedure is, at this time, to ship the adapters 74 with the container 42. Also, J-hooks 94 (or some modified form of a hanging device) can be shipped with the container 42 and adapters 74 as a total containing, mounting and display assembly.

It will be noted that with the two adapters 74 in their operating positions (as shown in FIGS. 5, 7, 8 and 9), the flat plate 76, fitting against the side wall 50 and having a rather small thickness dimension, takes up very little room in the containing space of the container 42. Thus, the contained product, such as a rectangular package as indicated at 40, can still be placed relatively snuggly in the container 42, even though the adapters 74 are not used. (This would occur, for example, if the container 42 is placed on a countertop in the manner of a conventional display container).

In the event that the spacing of the openings 106 in the pegboard 72 coes not closely match the horizontal width dimension of the container 42, the mounting of the J-hooks 94 would normally allow sufficient lateral shifting to accommodate this mismatch, and this is illustrated in FIG. 9. It can be seen that the hook 94 is slanted toward the left. This does not detract from the ability of the hook 94 to properly engage the mounting element 78 of the adapter 74.

A second embodiment of the present invention is shown in FIGS. 10–11. Components of this second embodiment which are similar to components of the first embodiment will be given like numerical designations, with an "a" suffix distinguishing those of the second embodiment.

As in the first embodiment, the mounting adapter **74*a* comprises a flat plate 76*a* having a flat contact surface 80*a* to engage the inside surface of a related side wall 50*a* of the container 42*a*. However, the mounting element 78*a*** is made somewhat differently.

More specifically, this mounting element **74*a* is made as a tab having a base portion 114 fixedly mounted to the plate 76*a*, and an outer hinged portion 116 connected to the base 114 by means of a living hinge 118. More specifically, the entire adapter 74*a* can be made as a piece of molded plastic, which is sufficiently flexible, so that the material at the hinge location 116 being made sufficiently thin, the hinged portion 116 can extend parallel to the plate 76*a*, or can be moved outwardly (as shown in broken lines of FIG. 11) so as to extend perpendicular to the plate 76*a*. It can be seen that the hinge location 118 is made so that the hinge surfaces 120 came into abutting engagement when the hinged portion 118** is in its outwardly extending position.

The hinged portion 118 is made with a through opening 122 to receive the hook portion **98*a* of a related J-hook 94*a***.

When the hinged portion 116 is positioned parallel to and closely adjacent to the plate **76*a*, the thickness dimension of the adapter 74*a* is rather small, and it's a relatively simple matter to store the adapter 74*a* within the container 42*a*. When it is desired to place the two adapters 74*a* into their operating position, the adapter 74*a* is positioned inside the container, the hinged portion 116 is pulled outwardly and inserted through an opening 90*a* in the container side wall 50*a*. It will be noted that the opening 90*a* has a smaller vertical dimension than the corresponding opening 90 of the first embodiment, due to the smaller vertical dimension of the mounting element 78*a*. In terms of the support function of the adapter 74*a*, this is accomplished in substantially the same manner as the first embodiment 74, so this will not be discussed in detail herein. Very briefly, the J-hook engages the mounting element 78*a* so that the vertical loads to support the container 42*a* and its contained product are resisted by engagement of the elements 78*a* with the downwardly facing top edge 92*a* of the opening 90*a***.

A significant benefit of the first two embodiments described above is that these can be readily incorporated with existing containers, with a minimum of retrofitting or adaptation of the containers. More specifically, it is simply required to form the openings in the side walls 50 or **50*a* of the containers 42 or 42*a*. The basic overall configuration of the container 42 or 42*a* can remain the same, and the formation of the openings 90 or 90*a* could be accomplished as a quite simple separate cutout or punching operation, or possibly combined into the existing operation of making the cardboard blank that is made into the container 42 or 42*a***.

Figure 12:
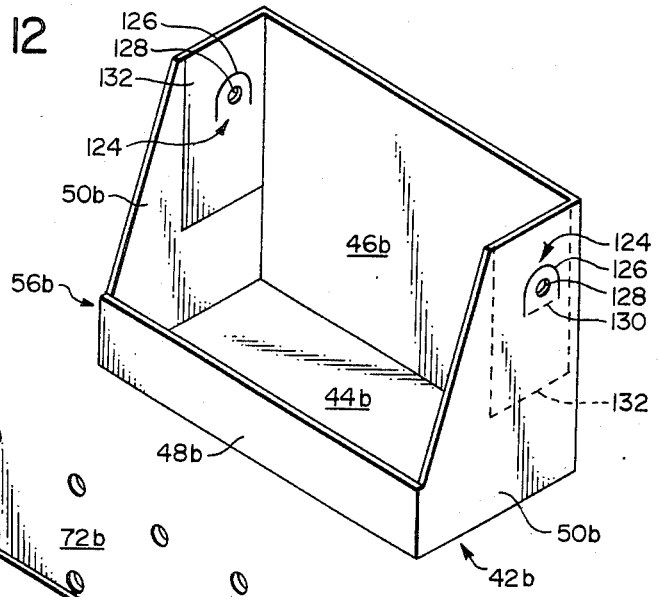
FIG. 12 is an isometric view of a container used in a third embodiment of the present invention, where the mounting elements are formed integrally with the container.
Figure 13:
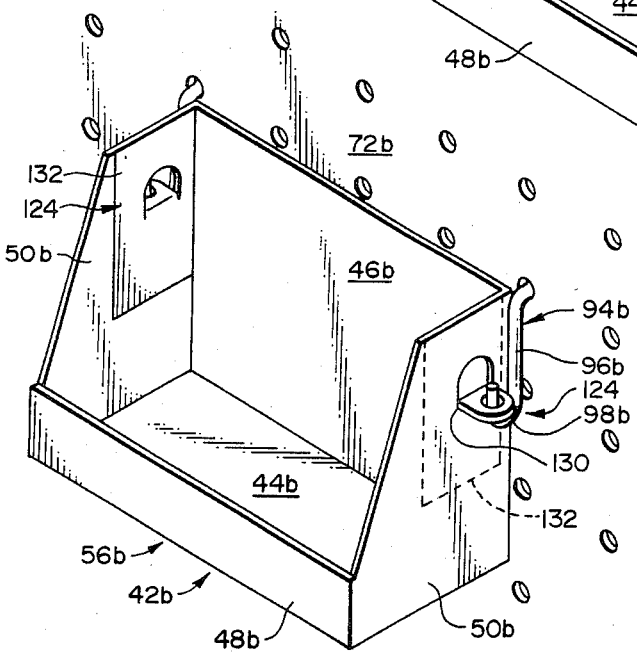
FIG. 13 is an isometric view similar to FIG. 12, showing the container of FIG. 11 with the mounting elements moved to their operating position and engaged by J-hooks to mount the container to a pegboard.

While the arrangement of the mounting adapter 74 and **74*a* is the general preferred arrangement of the present invention because of the particular unique advantages and features provided by these first two embodiments, within the broader scope of the system of the present invention, other means of utilizing a mounting device on the side walls of the container are possible. One such device is illustrated in FIGS. 12–13** which can be considered, within the broader aspects of the system of the present invention, a third embodiment. Components of this third embodiment which are similar to components of the first two embodiments will be given like numerical designation, with a "b" suffix distinguishing those of the third embodiment.

As in the first embodiment, there is a display container **42*b* which has (or may have) the same overall configuration as in the first two embodiments. However, a separate mounting adapter (such as previously disclosed as 74 and 74*a*) is not used. Rather, a mounting member, such as shown at 124 is made as part of the structure of the side wall 50*b*** itself.

More particularly, each side wall **50*b* has at its upper rear portion a tear line 126 having an overall configuration of an inverted "U". Within the semicircular portion of the "U" configuration, there is provided a through opening 128 arranged to receive the end hook portion 98*b* of a related J-hook 94*b***.

In operation, the mounting member is initially connected to (or made integral with), and aligned in the same plane with, its related side wall **50*b*. In this position, the container 42***b* can be used as a conventional shipping and/or storage container as described above. After the cover portion (not shown, but corresponding to the cover portion 54 of the first embodiment) is removed, the two mounting members or tabs 124 can be pushed outwardly to the positions shown in FIG. 12. Then the two J-hooks can be utilized to engage a related openings 128 in each of the mounting members or tabs 124 as shown in FIG. 12. Then the container 42*b* is mounted, as illustrated in FIG. 12, in generally the same manner as the first two embodiments.

One of the considerations of this third embodiment of FIGS. 12 and 13 is that the force generated by the weight of the container 42*b* and its contained product must be resisted not only at the juncture line 130 where the mounting member 124 joins to the side wall 50*b*, but also must be resisted at the location where the hook portion 98*b* of the J-hook 94*b* engages the surface defining the opening 128 in the mounting member 124. Since this is a relatively small contact area, the unit loading of the hook portion 98*b* engaging the surface of the opening 128 is relatively high. This in turn necessitates that the material forming the mounting member 124 be relatively strong. For this reason, a reinforcing sheet-like member 132 is bonded to the upper inside surface portion of each side wall 50*a*.

The mode of operation of this third embodiment is substantially the same as the prior two embodiments, except that the mounting inserts 74 and 74*a* are not inserted as separate elements.

Figure 14:
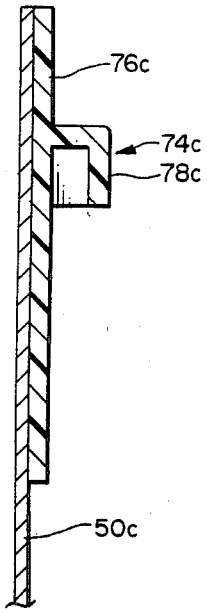
FIG. 14 is a side elevational view of a fourth embodiment of the present invention.

A fourth embodiment of the present invention is illustrated in FIG. 14. There is shown a portion of one of the side walls 50*c* and also an adaptor 74*c* comprising a plate 76*c* and a mounting element 78*c*. In this fourth embodiment, the plate 76*c* is bonded directly to the outside surface of the side wall 50*c*. Within the broader scope of the present invention, the adaptor 74*c* can be bonded to the side wall 50*c* in the initial formation of the container. Alternatively, the plate 76*c* could be provided with an adhesive inwardly facing surface which is covered by a removable cover. At the display location, the protective cover would be removed and the plate 76*c* pressed against the side wall 50*c* so as to be in bonding engagement therewith.

While the present invention is particularly suited to optimize the use of display cartons by providing the convenient location of display cartons to mounting boards, such as pegboards or slot boards, it is to be understood that within the broader aspects of the present invention, certain other applications may be contemplated. For example, in certain situations, the benefit of an actual display may have little, if any, importance, but the storage of articles for convenient access may be the primary consideration. Further, various modifications could be made without departing from the basic teachings of the present invention.

We claim:

1. A method of containing product for storage and/or shipping, and also mounting said product for display and/or convenient access, said method comprising:

a. providing a container having a base portion defining a containing area, and a movable cover portion which has a first enclosing position where the cover portion interfits with said base portion to enclose said product, and which is movable to a second position to expose said product in said containing area, said container being characterized in that said container base portion comprises at least two side walls, each having an inwardly facing surface and an outer surface, a bottom wall and a back portion, and the container being constructed so that with said product in the containing area, the container can be supported from said side walls;

b. enclosing said product in the container, with the container being in said first enclosing position;

c. subsequently moving the cover portion of the container from the enclosing position to an open position to expose the product within the base portion of the container;

d. providing at a connecting location at each side wall a related mounting member having a mounting element in a mounting position, with each mounting element being positioned outwardly of the outer surface of its related said side wall and with the mounting member being in supporting engagement with its related side wall in a manner to leave said containing area substantially unobstructed;

e. interconnecting each mounting element to vertically aligned support board means having a vertically aligned contact surface by a related one of two connecting members, each of which has a first connecting end engaging its related mounting element and a second mounting end engaging said support board means, in a manner to support the container base portion with the product therein from the support board means, with the back portion of the container bearing against the vertically aligned contact surface of the board means and the connecting members each exerting on the container base portion an upward and rearward force toward the board means.

2. The method as recited in claim 1, wherein each of said mounting members comprises a contact plate having a planar contact surface, said method further comprising forming each of said side walls with through opening means, and placing each of said contact plates with the contact surface engaging the inwardly facing surface of the side wall, with support means connecting to the contact plate being positioned in said opening means so as to be in supporting engagement therewith.

3. The method as recited in claim 2, wherein the support means of each of said mounting members comprises at least in part said mounting element being in bearing engagement with its related side wall.

4. The method as recited in claim 3, wherein said support means comprises at least one additional support element extending into said side wall so as to be in bearing engagement therewith.

5. The method as recited in claim 2, wherein each mounting element comprises a mounting structure having side wall means and a top wall, said mounting structure defining a downwardly extending opening to receive the first connecting end of the related connecting member.

6. The method as recited in claim 2, wherein each mounting element comprises a laterally extending mounting tab means extending through its related said opening means and having a through opening to receive the connecting end of the connecting member.

7. The method as recited in claim 6, wherein said tab means is hinge mounted relative to said contact plate, whereby said tab means can be positioned more closely adjacent said contact plate and also positioned to extend laterally outwardly from said contact plate.

8. The method as recited in claim 1, wherein each mounting member has a first position where said mounting member is aligned within its related side wall so as to form a part of said side wall, and said mounting member is moved outwardly from said side wall to said mounting position to interengage with its related connecting member.

9. The method as recited in claim 8, wherein each mounting member is formed integrally with its related said side wall as a portion thereof, and each mounting member is moved outwardly from its position within the said wall to said mounting position.

10. The method as recited in claim 9, further comprising providing each of said side walls with a reinforcing layer at a location of said mounting member at said side wall, with a portion of said reinforcing layer comprising a portion of said mounting member.

11. The method as recited in claim 1, wherein each of said mounting members is bonded to its related said side wall.

12. A packaging assembly for containing product for storage and/or shipping, and also mountng said product for display and/or convenient access, said assembly comprising:

a. container having a base portion defining a containing area, and a movable cover portion which has a first enclosing position where the cover portion interfits with said base portion to enclose said product, and which is movable to a second position to expose said product in said containing area, said container being characterized in that said container base portion comprises at least two side walls, each having an inwardly facing surface and an outer surface, and the container being constructed so that with said product in the containing area, the base portion with said product therein can be supported from said side walls;

b. a pair of mounting members, each of which is adapted to be mounted at a related one of said side walls at a mounting position, each mounting member having a mounting element which, with the mounting member in said mounting position, is positioned outwardly of the outer surface of its related said side wall and which is in supporting engagement with its related side wall in a manner to leave said containing area substantially unobstructed;

c. each of said mounting members comprising a contact plate having a planar contact surface, each of said side walls being formed with through opening means, each of said contact plates being adapted to have the contact surface engaging the inwardly facing surface of the side wall, with each contact plate having support means connected thereto and being adapted to be positioned in said opening means so as to be in supporting engagement therewith, whereby, with the two mounting members in their said mounting position, each mounting element can be connected to a board support means by a related one of two connecting members, each of which has a first connecting end engaging its related mounting element and a second mounting end engaging said support board means, in a manner to support the container base portion with the product therein from the support board means.

13. The assembly as recited in claim 12, wherein the support means of each of said mounting members comprises at least in part said mounting element which is adapted to be in bearing engagement with its related said side wall.

14. The assembly as recited in claim 13, wherein said support means comprises at least one additional support element extending into said side wall so as to be in bearing engagement therewith.

15. The assembly as recited in claim 12, wherein each mounting element comprises a mounting structure having side wall means and a top wall, said mounting structure defining a downwardly extending opening to receive the first connecting end of the related connecting member.

16. The assembly as recited in claim 12, wherein each mounting element comprises a laterally extending mounting tab means which is adapted to extend through its related said opening means and having a through opening to receive the connecting end of the connecting member.

17. The assembly as recited in claim 16, wherein said tab means is hinge mounted relative to said contact plate, whereby said tab means can be positioned more closely adjacent said contact plate and also positioned to extend laterally outwardly from said contact plate.

18. A mounting assembly for mounting product for display and/or convenient access, said assembly comprising:

a. a base container defining a containing area to support said product in a manner to expose said product in said containing area, said base container comprising at least two side walls, each having an inwardly facing surface and an outer surface, a bottom wall and a back portion, and the base container being constructed so that with said product in the containing area, the base container with said product therein can be supported from said side walls;

b. a pair of mounting members, each of which is mounted at a related one of said side walls at a mounting position, each mounting member having a mounting element which is positioned outwardly of the outer surface of its related said side wall and which is in supporting engagement with its related side wall in a manner to leave said containing area substantially unobstructed;

c. vertically aligned board support means having a vertically aligned contact surface and a plurality of spaced mounting locations thereon some of which are vertically spaced from one another;

d. a pair of connecting members, each of which has a first connecting end engaging a related one of said mounting elements and a second mounting end engaging said board support means at a selected one of said mounting locations, in a manner to support the base container with the product therein from the board support means, said connecting members being characterized in that each connecting member exerts an upward and rearward force from its related mounting member to said board support means with the back portion of the container bearing against the vertically aligned contact surface of the board support means.

19. The assembly as recited in claim 18, wherein each of said mounting members comprises a contact plate having a planar contact surface, each of said side walls being formed with through opening means, each of said contact plates being adapted to have the contact surface engaging the inwardly facing surface of the side wall, with each contact plate having support means connected thereto and being adapted to be positioned in said opening means so as to be in supporting engagement therewith.

20. The assembly as recited in claim 19, wherein the support means of each of said mounting members comprises at least in part said mounting element which is adapted to be in bearing engagement with its related said side wall.

21. The assembly as recited in claim 20, wherein said support means comprises at least one additional support element extending into said side wall so as to be in bearing engagement therewith.

22. The assembly as recited in claim 19, wherein each mounting element comprises a mounting structure having side wall means and a top wall, said mounting structure defining a downwardly extending opening to receive the first connecting end of the related connecting member.

23. The assembly as recited in claim 19, wherein each mounting element comprises a laterally extending mounting tab means which is adapted to extend through its related said opening means and having a through opening to receive the connecting end of the connecting member.

24. The assembly as recited in claim 23, wherein said tab means is hinge mounted relative to said contact plate, whereby said tab means can be positioned more closely adjacent said contact plate and also positioned to extend laterally outwardly from said contact plate.

25. The assembly as recited in claim 18, wherein each mounting member has a first position where said mounting member is aligned within its related said wall so as to form a part of said side wall, and said mounting member is moved outwardly from said side wall to said mounting position to interengage with its related connecting member.

26. The assembly as recited in claim 25, wherein each mounting member is formed integrally with its related said side wall as a portion thereof, and each mounting member is moved outwardly from its position within the side wall to said mounting position.

27. The assembly as recited in claim 26, wherein each of said side walls has a reinforcing layer at a location of said mounting member at said side wall, with a portion of said reinforcing layer comprising a portion of said mounting member.

28. The assembly as recited in claim 18, wherein each of said mounting members is bonded to its related said side wall.

* * * * *